US007811126B1

(12) United States Patent
Chen

(10) Patent No.: US 7,811,126 B1
(45) Date of Patent: Oct. 12, 2010

(54) LOCKING CONNECTOR

(75) Inventor: Hsiang Feng Chen, Tainan County (TW)

(73) Assignee: Aimmet Industrial Co., Ltd., Tainan County (TW)

( * ) Notice: Subject to any disclaimer, the term of this patent is extended or adjusted under 35 U.S.C. 154(b) by 0 days.

(21) Appl. No.: 12/683,177

(22) Filed: Jan. 6, 2010

(51) Int. Cl.
*H01R 13/40* (2006.01)

(52) U.S. Cl. ..... 439/595; 439/752; 439/903; 439/752.5

(58) Field of Classification Search ..... 439/660, 439/595, 752, 903, 752.5, 455
See application file for complete search history.

(56) References Cited

U.S. PATENT DOCUMENTS 7,247,051 B2 * 7/2007 Hou ..... 439/595
7,384,309 B1 * 6/2008 Morello et al. ..... 439/595
7,563,135 B2 * 7/2009 Takahashi et al. ..... 439/595
2003/0092324 A1 * 5/2003 Walker et al. ..... 439/752

FOREIGN PATENT DOCUMENTS

TW 200505109 2/2005

* cited by examiner

*Primary Examiner*—T C Patel
*Assistant Examiner*—Phuong Nguyen
(74) *Attorney, Agent, or Firm*—J.C. Patents

(57) ABSTRACT

A connector includes a body, a terminal base and a fixing base. The body has a terminal base groove consisting of a circular portion and a square portion suited to the profile of the terminal base. A protective base is provided to protect a first tenon from erroneously touched. A second tenon is utilized to engage with an annular recessed groove of the terminal base to combine the body with the terminal base in a first stage. The body has two sides having a first engaging projecting member and plural second engaging projecting members for engaging with those of the fixing base to complete a two-step engagement to enable the body, the terminal base and the fixing base combined together. The fixing base includes plural projecting-out rods and projecting-up rods to make the body combined with the fixing base, facilitating the connector conveniently assembled.

16 Claims, 8 Drawing Sheets

LOCKING CONNECTOR

BACKGROUND OF THE INVENTION

1. Field of the Invention

This invention relates to a connector, particularly to one employing a second tenon provided in a body to initially combine with a terminal base before combining the body with the terminal base by means of a fixing base, enabling the connector assembled easily and conveniently.

2. Description of the Prior Art

A conventional connector, such as the one disclosed in Taiwan Patent No. 234316 on Jun. 11, 2005 and authorized to this applicant, mainly includes a body having a terminal base groove formed inside for accommodating a terminal base. The terminal base groove is provided with a calibrating groove located in a front circumference. The body also has a tenon formed in a tenon groove that is extended backward to integrate with the body so as to form a connecting rib and a pressing grip. A plurality of petals are formed around the rear side of the terminal base groove for combining with the terminal base. The terminal base is made of metal, provided with a large circumference and a small circumference for correspondingly engaging with the inner wall of the terminal base groove, so that the terminal base can be fixedly combined with the body. And the terminal base accommodates at least a terminal. However, as the terminal base of the conventional connector is formed circular, it is to freely rotate after being assembled with the body without any further tackling, posing an annoyance for using or assembling.

SUMMARY OF THE INVENTION

The object of this invention is to offer a connector that has a body combined with a terminal base in a first stage and then has a fixing base combined with the body in a second stage, so as to keep the terminal base stably positioned.

The main characteristics of the invention are a body, a terminal base and a fixing base.

The body has a terminal base groove consisting of a circular portion and a square portion suited to the profile of the terminal base, so as to smoothly direct the terminal base to combine with the terminal base groove to avoid the problem that a terminal may be misplaced.

The body has a front portion provided with a first tenon formed on the top for being combined with an exterior connector.

The front portion of the body is provided with a second tenon formed on the bottom for being combined with the terminal base in a first stage so as to combine the body with the terminal base initially.

The body has a rear portion having two sides respectively provided with a first engaging projecting member and plural second engaging projecting members for being combined with engaging members of the fixing base in a two-step combination, so as to completely combine the body with the terminal by means of the fixing base.

The terminal base is composed of a circular portion and a square portion, with the circular portion combined with the circular portion of the terminal base groove of the body, with the square portion combined with the square portion of the terminal base groove of the body, so that the terminal base may extend in the terminal base groove properly. The terminal base is further provided with an annular recessed groove employed to combine with the second tenon so as to combine the terminal base with the body initially.

The fixing base includes a lower wall provided with plural projecting-out rods formed at the front end for extending in two sides of the second tenon, and plural projecting-up rods formed on the inner surface to extend in the body, so that the body and the fixing base may tightly be combined together.

The fixing base further has two sidewalls respectively provided with a first engaging projecting member and plural second engaging projecting members suited to the first engaging projecting member and the second engaging projecting members formed on two sides of the body, so that the body and the fixing base may tightly be combined together by the fixing base.

BRIEF DESCRIPTION OF DRAWINGS

This invention is better understood by referring to the accompanying drawings, wherein.

DETAILED DESCRIPTION OF THE PREFERRED EMBODIMENT

As shown in FIGS. 1~4, a preferred embodiment of a connector in the present invention includes at least a body 1, a terminal base 2 and a fixing base 3.

Figure 4:
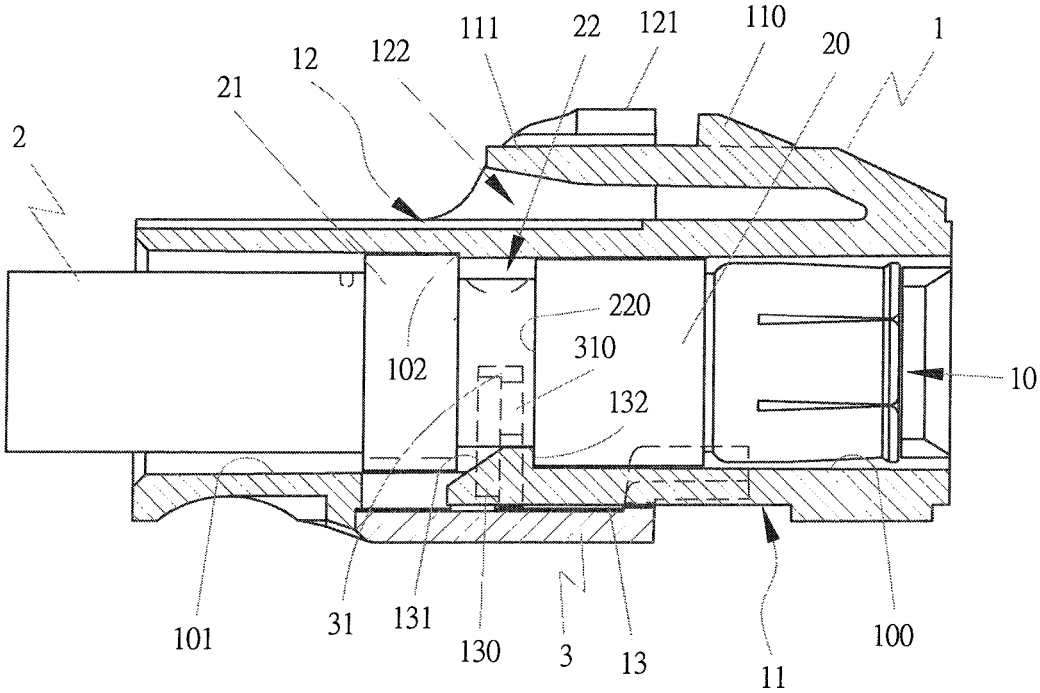
FIG. 4 is a cross-sectional view of a 'A-A' line in FIG. 3.
Figure 5:
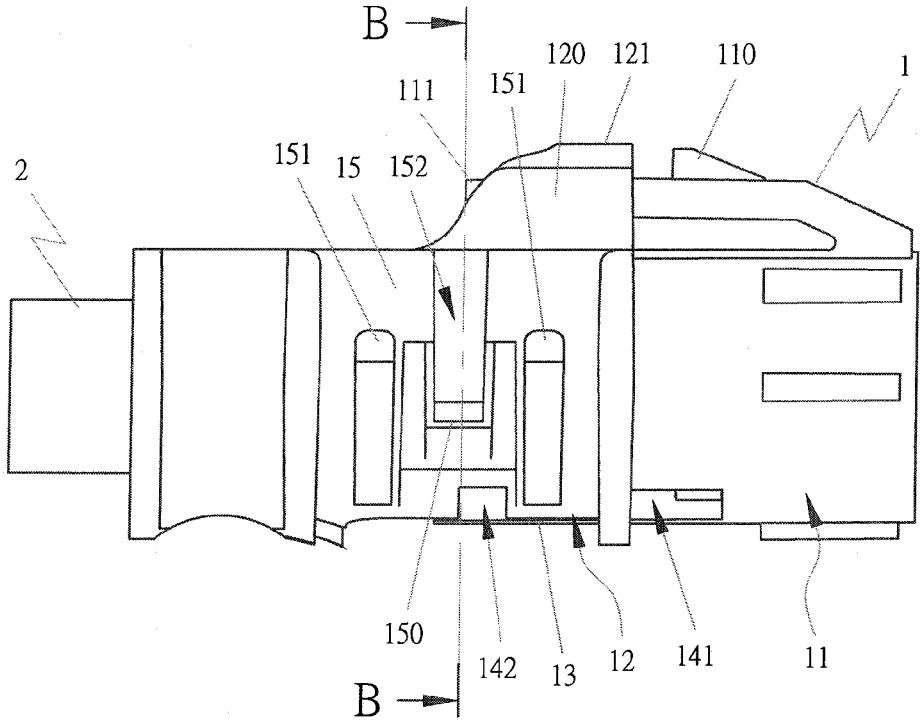
FIG. 5 is a partial side view of the preferred embodiment of a connector in the present invention.
Figure 6:
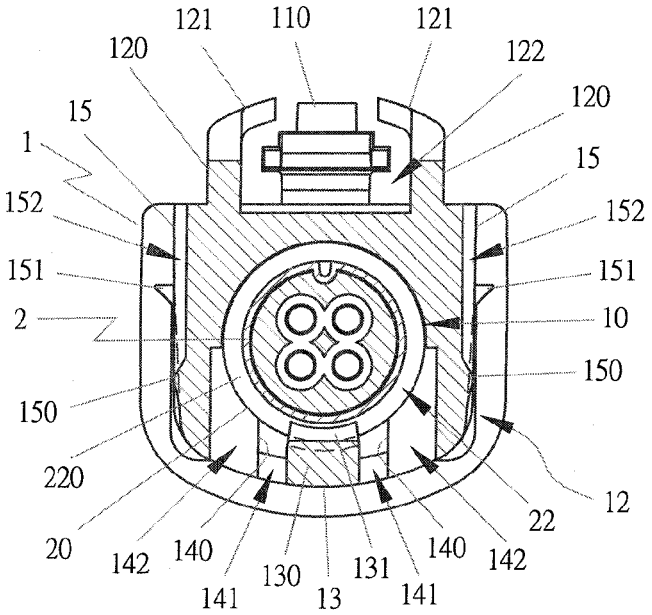
FIG. 6 is a cross-sectional view of a 'B-B' line in FIG. 5.

The body 1 has a terminal base groove 10 consisting of a circular portion 100 and a square portion 101, with a variable length ratio for the circular portion 100 and the square portion 101 depending on practical requirement and the shape of the terminal base 2. A blocking circumference 102 is provided between the circular portion 100 and the square portion 100, as shown in FIG. 4, so that there is a limited depth for the terminal base 2 to be inserted in the terminal base groove 10. Further the square portion 101 of the terminal base groove 10 has an inclined surface to suit to the profile of the terminal base 2 for smoothly directing the terminal base 2 to combine with the terminal base groove 10, so as to avoid the problem that a terminal may be misplaced.

The body 1 is further constituted of a front portion 11 and a rear portion 12. The front portion 11 has a round or other shapes as long as being able to engage with an exterior connector (not shown in Figs.) and the rear portion 12 has a shape similar to a square or others. The front portion 11 is provided with a first tenon 110 formed on the top for connecting an exterior connector, and a grip 111. The first tenon 110, extending from the first end of the first portion 11 into two protective bases 120, can be elastically curved downward while pressing the grip 111 and rebound to its original position after releasing the grip 111. The two protective bases 120 protrude upward from two sides of the rear portion 12, respectively with an end 121 symmetrically curved to form a protecting space 122 for accommodating the first tenon 110 to prevent the grip 111 from erroneously touched.

As shown in FIGS. 2 and 4~8, the front portion 11 of the body 1 is further provided with a second tenon 13 in the lower section, which extends from the rear end of the front portion 11 to the top of an opening 14 of the rear portion 12. The second tenon 13 possesses a locking portion 130 formed in the bottom of the end, which consists of an inclined surface 131 formed at the front and a vertical surface 132 formed behind the inclined surface 131. With the vertical surface 132 of the second tenon 13 locked in a recessed circular groove 22 of the terminal base 2, the second tenon 13 can be firstly fixed with the terminal base 2 so that the terminal base 2 may be combined with the body 1 initially.

As mentioned previously, the opening 14 formed in the rear portion 12 is employed to accommodate the second tenon 13, with an interval 141 formed between the second tenon 13 and two sidewalls 140 of the opening 14 respectively for being inserted by projecting-out rods 300 of a lower wall 30 of the fixing base 3. In addition, two side recessed grooves 142 (shown in FIG. 2) are respectively formed in two sides of the opening 14 for two projecting-up rods 31 of the fixing base 3 to extend up through.

Figure 1:
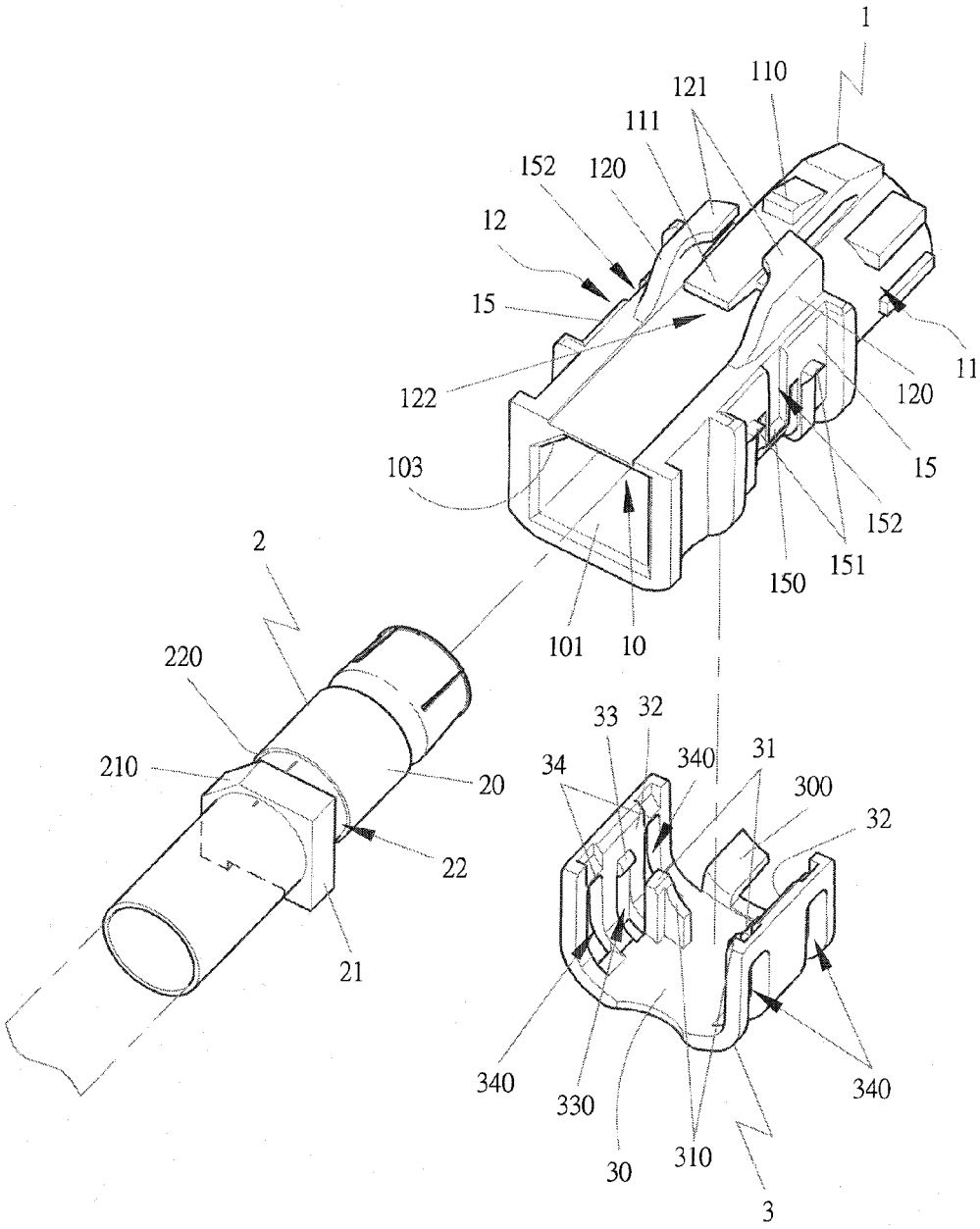
FIG. 1 is an exploded perspective view of a preferred embodiment of a connector in the present invention.
Figure 2:
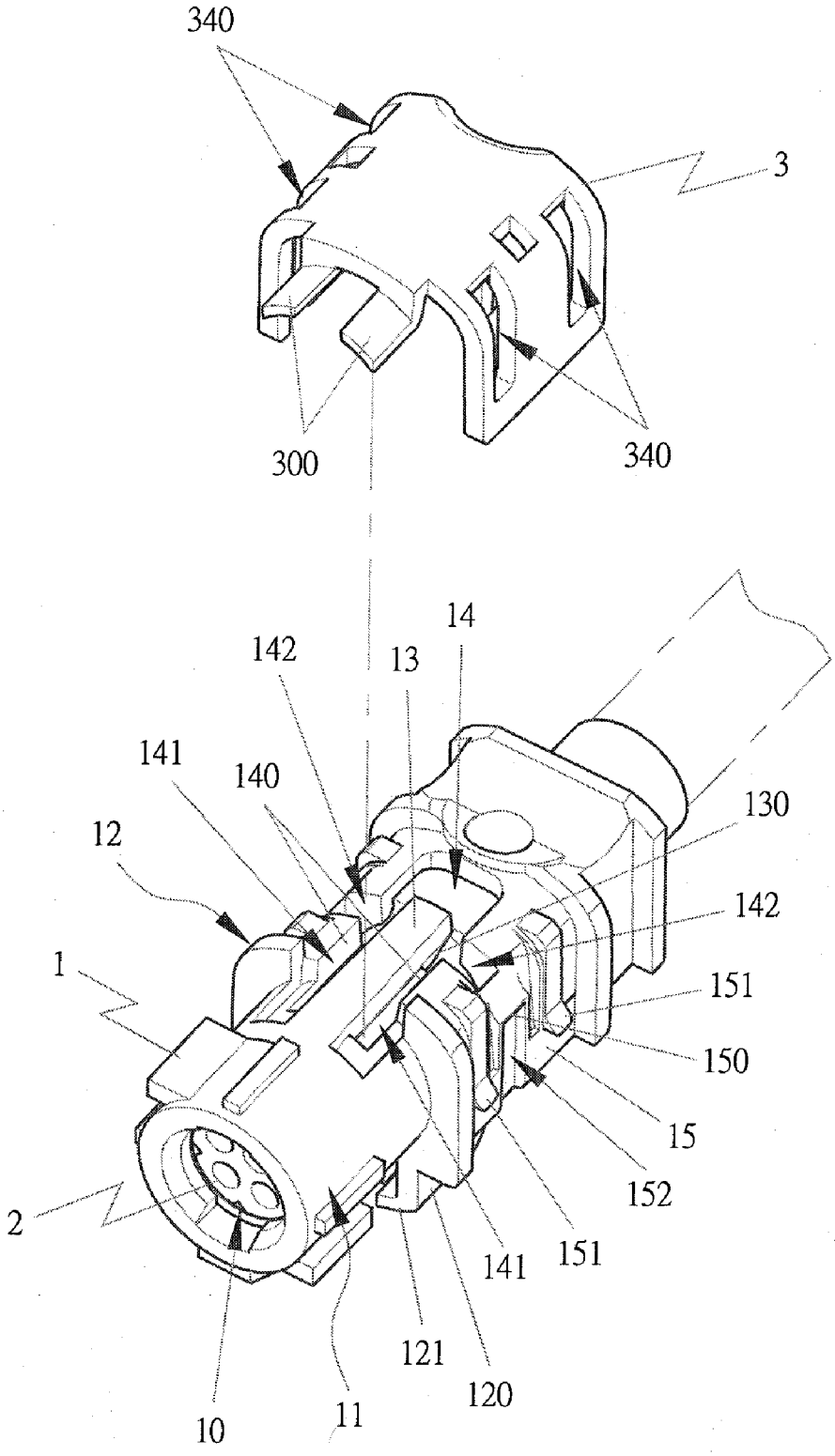
FIG. 2 is a partial exploded perspective view of the preferred embodiment of a connector in the present invention.
Figure 3:
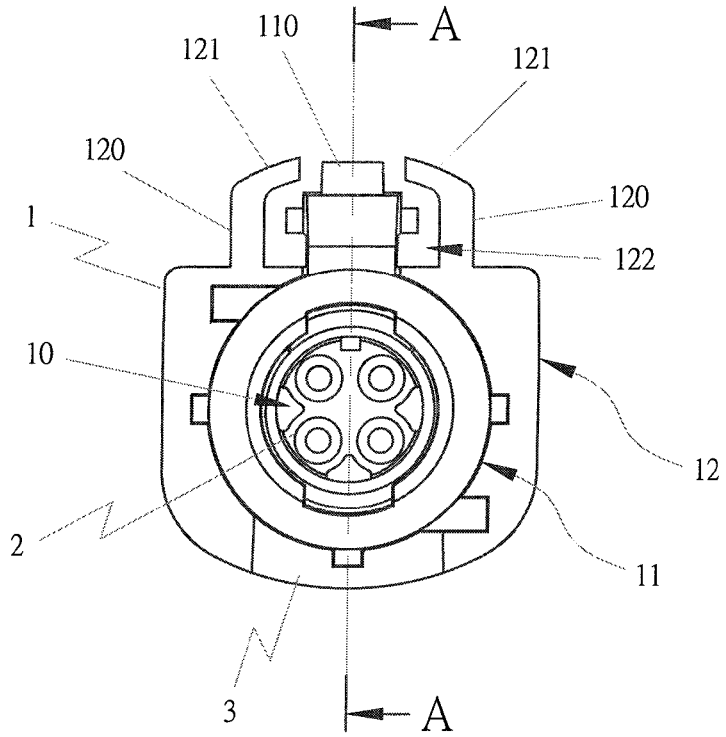
FIG. 3 is a front view of the preferred embodiment of a connector in the present invention.

Moreover, as shown in FIGS. 1 and 2, the rear portion 12 of the body 1 has two sides respectively provided with a first engaging projecting member 150 and plural second engaging projecting members 151, with the first engaging projecting member 150 positioned lower than the second engaging projecting members 151. Formed above the first engaging projecting member 150 is a recessed groove 152 utilized to initially engage with a first engaging projecting member 33 formed in two sidewalls 32 of the fixing base 3 respectively. The second engaging projecting members 151 protrude outward at two sides of the front portion 11 to mutually engage with two second engaging projecting members 34 of the fixing base 3 so that the fixing base 3 may be combined with the body 1 for the second stage, so as to combine the body 1 with the terminal base 2 completely and stably.

As shown in FIGS. 1 and 4, the terminal base 2 is composed of a circular portion 20 and a square portion 21, with the circular portion 20 combined with the circular portion 100 of the terminal base groove 10 of the body 1, with the square portion 21 combined with the square portion 101 of the terminal base groove 10 of the body 1, so that the terminal base 2 may extend in the terminal base groove properly. The square portion 21 is provided with an inclined surface 210 for engaging with the inclined surface 103 of the square portion 101 of the terminal base grove 10 of the body 1, able to direct the terminal base 2 to engage with the terminal base groove 10 without misplaced. The terminal base 2 is further provided with a recessed circular groove 22 having a front wall 220 used for combining with the second tenon 13 positioned under the front portion 11 of the body 1 so as to combine the terminal base 2 with the body 1 initially.

As shown in FIGS. 1 and 2, the fixing base 3 includes the lower wall 30 mentioned above, which has plural projecting-out rods 300 formed at the front end for extending in the intervals 141 formed between the second tenon 13 and the two sidewalls 140 of the opening 14. The fixing base 3 further has plural projecting-up rods 31 formed on an intermediate portion of the inner surface of the lower wall 30 and respectively provided with a curved surface 310. The projecting-up rods 31 may extend through the side recessed grooves 142 of the body 1 into the recessed circular groove 22 of the terminal base 2 to enable the curved surface 310 to tightly contact with an annular surface of the terminal base 2 so that the body 1 and the fixing base 3 may tightly be combined together.

Figure 7:
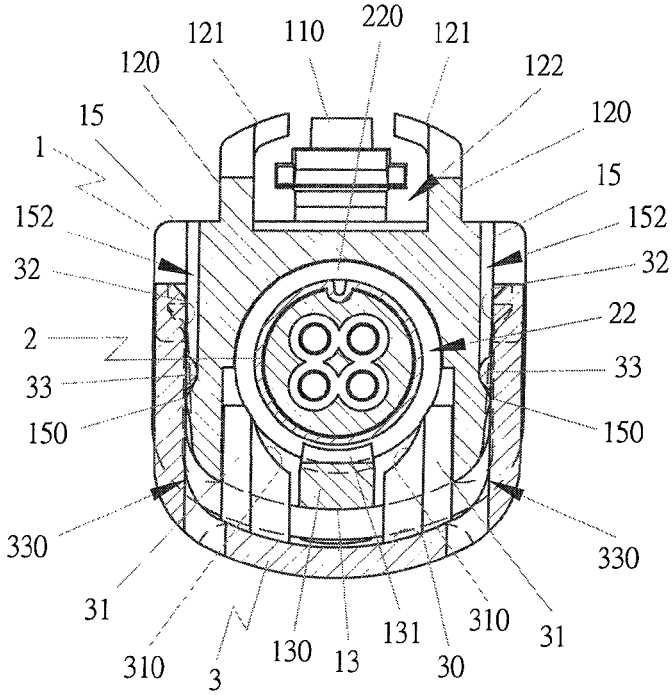
FIG. 7 is a cross-sectional view of the preferred embodiment of a connector in the present invention, showing a first-stage combination of a fixing base and a body.
Figure 8:
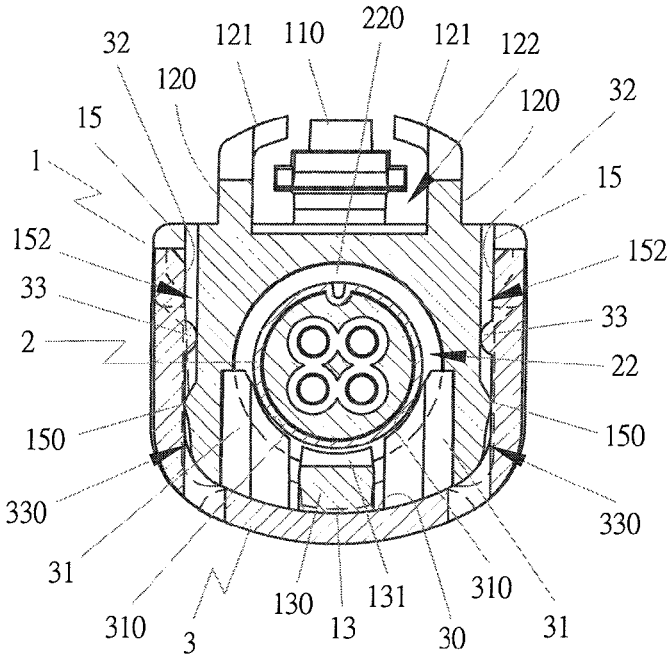
FIG. 8 is a cross-sectional view of the preferred embodiment of a connector in the present invention, showing a second-stage combination of a fixing base and a body.
Figure 9:
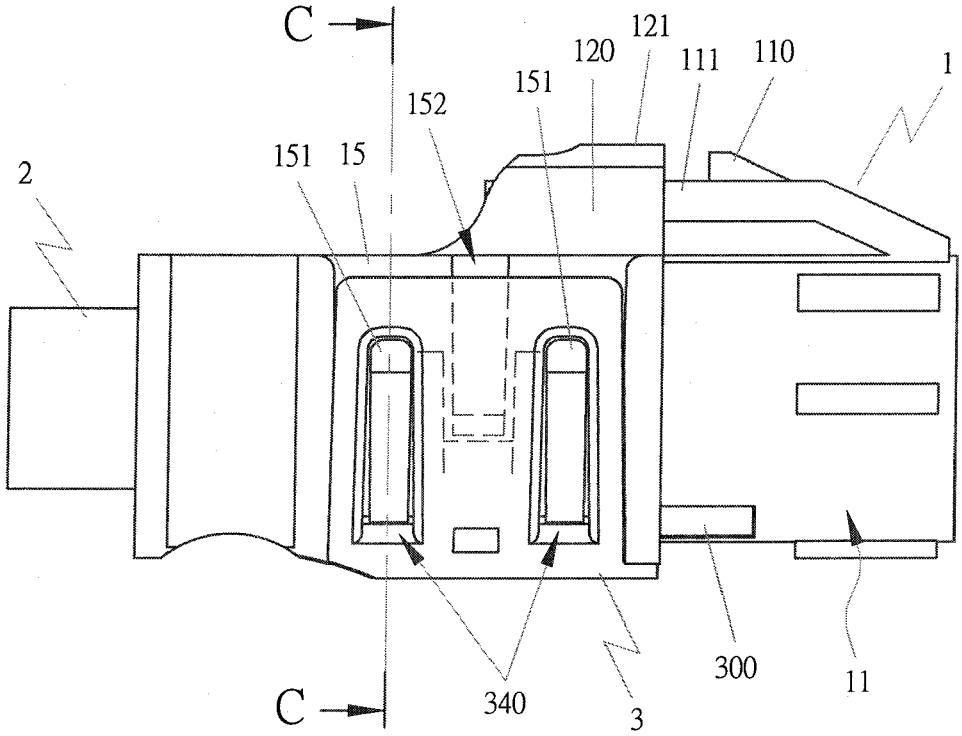
FIG. 9 is a view of the preferred embodiment of a connector in the present invention.
Figure 10:
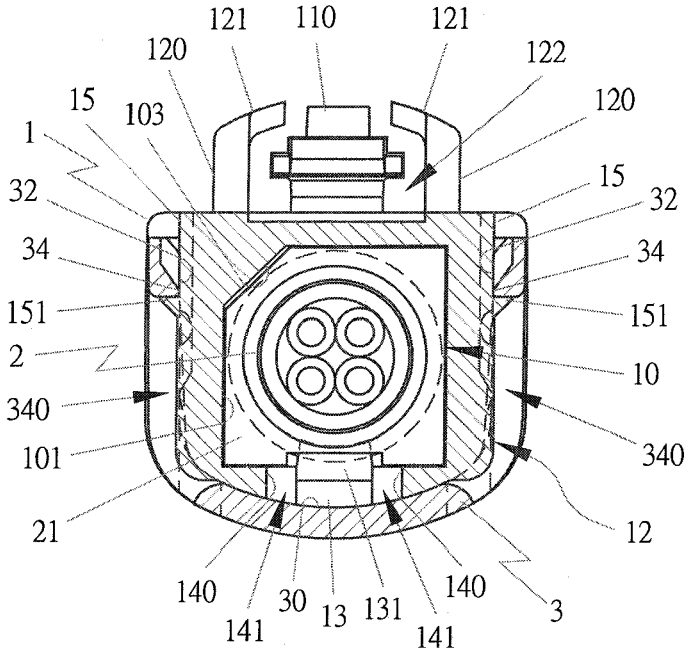
FIG. 10 is a cross-sectional view of a 'C-C' line in FIG. 9.
Figure 11:
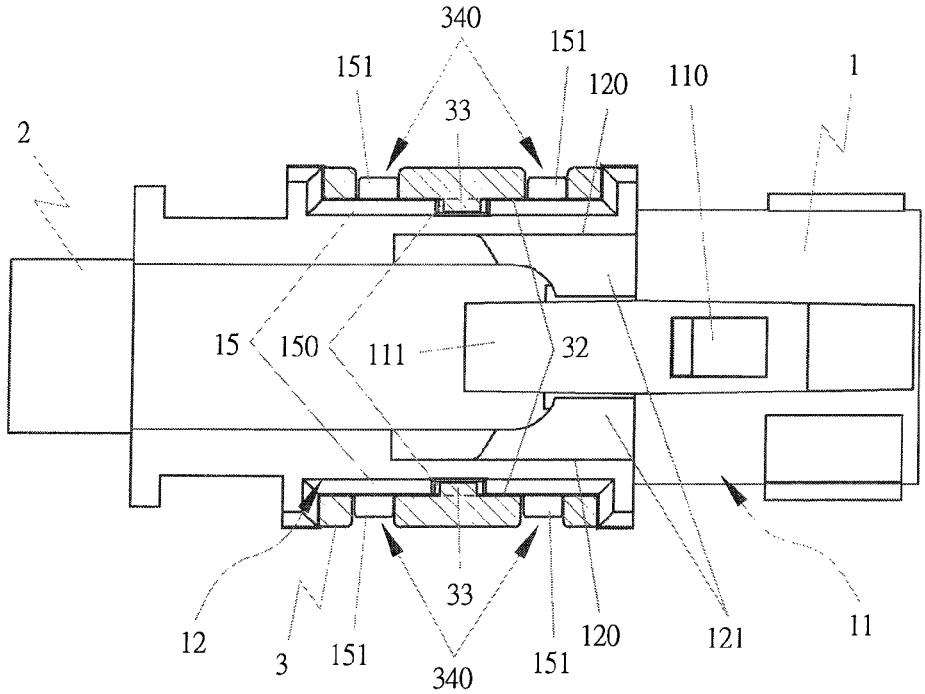
FIG. 11 is a partial top view of the preferred embodiment of a connector in the present invention.
Figure 12:
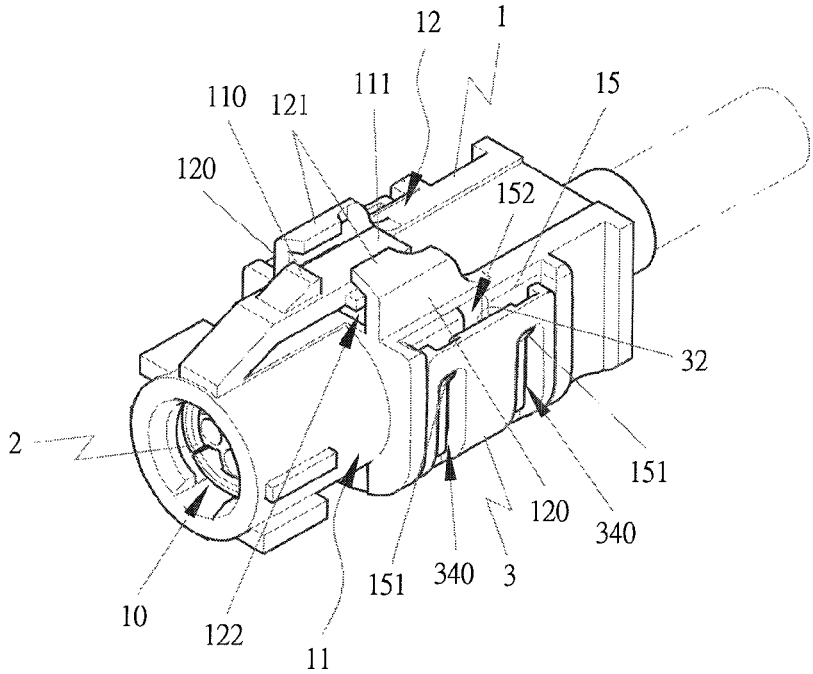
FIG. 12 is a perspective view of the preferred embodiment of a connector in the present invention.
Figure 13:
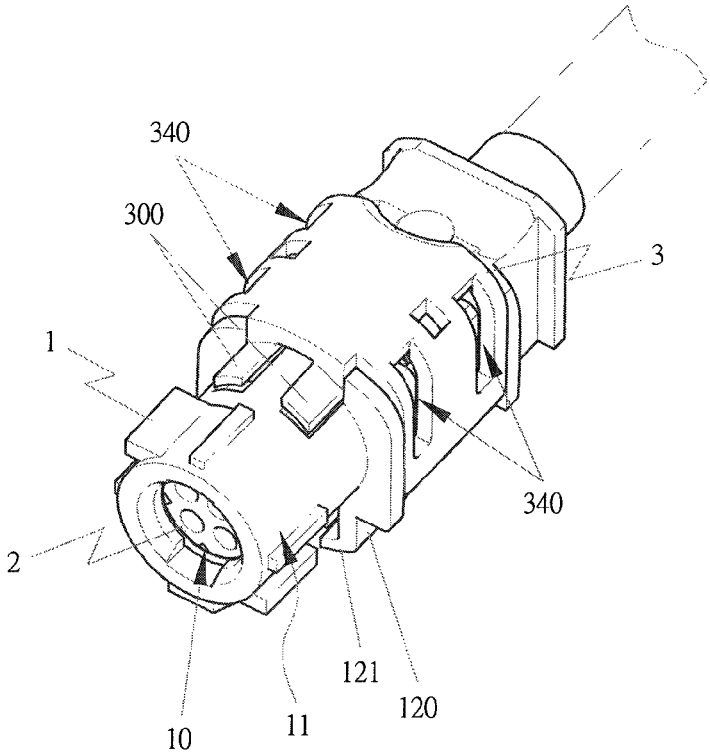
FIG. 13 is a perspective view of the preferred embodiment of a connector in the present invention, showing the first-stage combination of the fixing base and the body.
Figure 14:
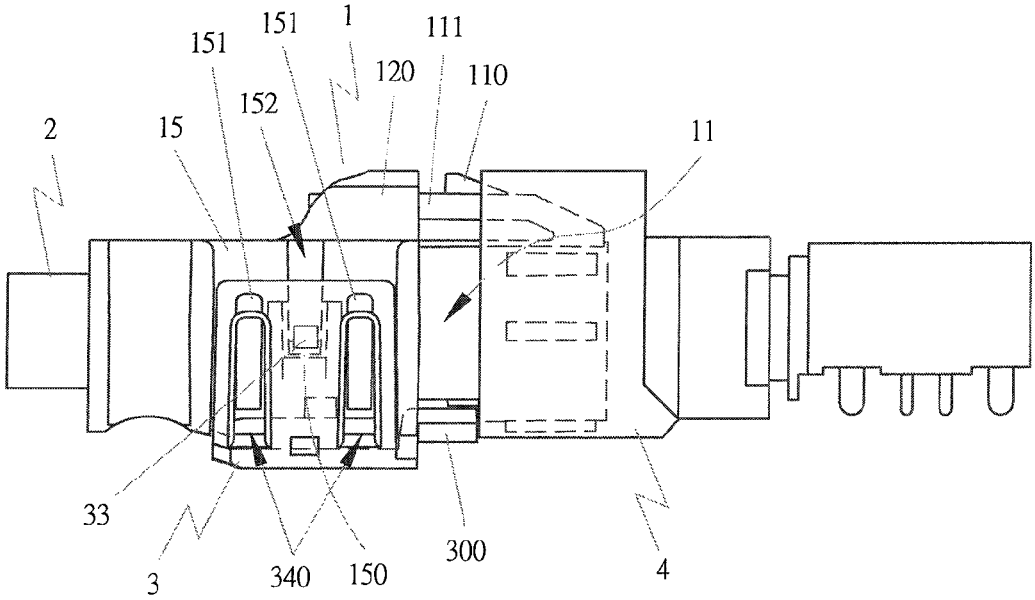
FIG. 14 is a side view of FIG. 13, showing the connector unable to be connected with an exterior connector.

Moreover, the fixing base 3 includes two sidewalls 32 respectively provided with a first engaging projecting member 33 and plural second engaging projecting members 34. The first engaging projecting member 33 protrudes out from the sidewalls 32, with a guiding groove 330 formed below it, as shown in FIG. 9, and the second engaging projecting members 34 are formed oblique, with a guiding hole 340 formed below each of them, as shown in FIGS. 1 and 10. Thus when the sidewalls 32 of the fixing base 3 is combined with two sides of the body 1, the guiding groove 330 of the first engaging projecting member 33 of the fixing base 3 may direct the first engaging projecting member 150 of the body 1 to keep the fixing base 3 combined with the body 1 with a certain extent so as to enable the first engaging projecting member 150 of the body 1 primarily engaged with the first engaging projecting member 33 of the fixing base 3 for a first stage combination because the first engaging projecting member 33 is located lower than the second engaging projecting members 34, as shown in FIG. 7. By the time, as shown in FIG. 13, the projecting-out rods 300 are not yet extended into the interval 141 formed between the two sidewalls 140 of the opening 14 and the second tenon 13, staying in a pose protruding outward to thereof block any exterior connector from inserted into the connector. That is, the connector is impossible to be connected with any exterior connector before the connector itself is assembled completely. Next, as shown in FIGS. 10~12, when the fixing base 3 is further combined with the body 1 to complete a second stage of combination, with the second engaging projecting members 151 of the body 1 combined with the second engaging projecting members 34 of the fixing base 3, the assembly of the connector is totally finished.

The advantages of the invention are described as can be seen from the foresaid description. By means of the second tenon 13, the terminal base 2 can be combined with the body 1 initially. By extending the fixing base 3 through the opening 14 into the body 3, the first engaging projecting member 33 and the second engaging projecting members 34 of the fixing base 3 can respectively be combined with the first engaging projecting member 150 and the second engaging projecting members 151 of the body 1, with the projecting-up rods 31 of the fixing base 3 extending in the recessed circular groove 22 of the terminal base 2. The body 1, the terminal base 2 and the fixing base 3 may thus easily and stably assembled all together. The connector is qualitatively improved as the polarity of each terminal is explicitly set up, practically usable as a male or a female one.

While the preferred embodiment of the invention has been described above, it will be recognized and understood that various modifications may be made therein and the appended claims are intended to cover all such modifications that may fall within the spirit and scope of the invention.

What is claimed is:

1. A connector at least comprising:

a body having a terminal base groove consisting of a circular portion and a square portion suited to a terminal base, said body further constituted of a front portion and a rear portion, said front portion provided with a first tenon extending from a first end into two protective bases of said rear portion so as to prevent a grip of said first tenon from being erroneously touched, said front portion further provided with a second tenon employed to combine with a front wall of a recessed circular groove of a terminal base so as to initially establish a first stage combination of said body and said terminal base, said rear portion of said body having two sides respectively provided with a first engaging projecting member and plural second engaging projecting members that are utilized to respectively engage with a first engaging projecting member and plural second engaging projecting members of said fixing base so that said body can be completely combined with said terminal base by means of said fixing base;

said terminal base composed of a circular portion and a square portion, said circular portion of said terminal base used to combine with said circular portion of said terminal base groove of said body, said square portion of said terminal base used to combine with said square portion of said terminal base groove of said body, said recessed circular groove of said terminal base being combined with said second tenon of said terminal base to complete a first stage combination of said body and said terminal base; and said fixing base possessing a lower wall provided with plural projecting-out rods for extending in two sides of said second tenon of said body, said lower wall further provided with plural projecting-up rods formed on an inner surface to extend through said body to be locked in said recessed circular groove of said terminal base so as to combine said terminal base with said body more stably, said fixing base further having two sidewalls respectively provided with a said first engaging projecting member and two said second engaging projecting members utilized to respectively engage with said first engaging projecting member and said second engaging projecting members of said body so that said terminal base can be completely combined with said body by means of said fixing base.

2. The connector as claimed in claim 1, wherein a blocking circumference is provided between said circular portion and said square portion of said terminal base groove of said body to keep said terminal base from overextending in said terminal base groove.

3. The connector as claimed in claim 1, wherein said square portion of said terminal base groove of said body has an inclined surface to suit to a profile of said terminal base for smoothly directing said terminal base to combine with said terminal base groove.

4. The connector as claimed in claim 1, wherein said front portion of said body is formed round and said rear portion is formed nearly square.

5. The connector as claimed in claim 1, wherein said grip of said first tenon of said body extends backward into two said protective bases of said rear portion.

6. The connector as claimed in claim 1, wherein said protective bases of said body protrude upward from two sides of said rear portion to respectively have an end symmetrically curved to form a protecting space for accommodating said first tenon to prevent said grip from erroneously touched.

7. The connector as claimed in claim 1, wherein said second tenon possesses a locking portion formed in a bottom of an end and consisting of an inclined surface formed at a front portion, a vertical surface formed behind said inclined surface for being locked in said recessed circular groove of said terminal base to make said second tenon combined with said terminal base as a first stage of combination so that said terminal base may be combined with said body initially.

8. The connector as claimed in claim 1, wherein said rear portion of said body is provided with an opening employed to accommodate said second tenon, an interval formed between said second tenon and two sidewalls of said opening respectively and utilized to be inserted by said projecting-out rods of said lower wall of said fixing base, two side recessed grooves respectively formed in two sides of said opening for said projecting-up rods of said fixing base to extend up through.

9. The connector as claimed in claim 1, wherein said first engaging projecting member of said rear portion of said body is positioned lower than said second engaging projecting members of said body, a recessed groove formed above said first engaging projecting member of said body for being combined with said first engaging projecting member of said fixing base to effect a first stage of engagement.

10. The connector as claimed in claim 1, wherein said square portion of said terminal base has an inclined surface profiled to suit to said square portion of said terminal base groove of said body.

11. The connector as claimed in claim 1, wherein said projecting-out rods formed at a front portion of said lower wall of said fixing base extend in said intervals formed between said second tenon of said body and two said sidewalls of said opening.

12. The connector as claimed in claim 1, wherein said first engaging projecting member of said fixing base protrudes above two sidewalls of said fixing base, and a guiding groove is formed below said first engaging projecting member.

13. The connector as claimed in claim 1, wherein said projecting-out rods of said fixing base do not extend in said intervals formed between said second tenon and said sidewalls of said opening as fixing base is combined with said body in first stage of combination but protrude outwards so as to keep said connector from being inserted by any exterior connector before said connector itself is completely assembled.

14. The connector as claimed in claim 1, wherein said second engaging projecting members are formed oblique.

15. The connector as claimed in claim 1, wherein a guiding hole is formed below each of said second engaging projecting members.

16. The connector as claimed in claim 1, wherein each of said projecting-up rods of said fixing base is provided with a curved surface to tightly contact with an annular surface of said terminal base so that said body and said fixing base may tightly be combined together.

* * * * *